US005456313A

United States Patent [19]

Hopper et al.

[11] Patent Number: 5,456,313

[45] Date of Patent: Oct. 10, 1995

[54] MODULAR CONTROL SYSTEM

[75] Inventors: Hans P. Hopper, Hillhouse, Scotland; Klaus Biester, Wienhausen, Germany; Richard J. Emptage, Strachan Banchory, Scotland

[73] Assignee: Cooper (Great Britain) Limited, United Kingdom

[21] Appl. No.: 251,900

[22] Filed: Jun. 1, 1994

[30] Foreign Application Priority Data

Jun. 4, 1993 [GB] United Kingdom ..... 9311583

[51] Int. Cl.[6] ..... E21B 7/00; E21B 34/00

[52] U.S. Cl. ..... 166/97.1; 166/368

[58] Field of Search ..... 166/75.1, 86, 87, 166/95, 97, 350, 368

[56] References Cited

U.S. PATENT DOCUMENTS

| | | | |
|---|---|---|---|
| 2,990,851 | 7/1961 | Jackson, Jr. et al. | 137/595 |
| 3,640,299 | 2/1972 | Nelson | 137/1 |
| 3,817,281 | 6/1974 | Lewis et al. | 137/594 |
| 3,820,600 | 6/1974 | Baugh | 166/0.6 |
| 4,046,192 | 9/1977 | Darnborough et al. | 266/0.6 |
| 4,328,826 | 5/1982 | Baugh | 137/236 |
| 4,364,433 | 12/1982 | Fisher et al. | 166/339 |
| 4,405,014 | 9/1983 | Talafuse | 166/97 |
| 4,461,354 | 7/1984 | Buras et al. | 166/97 X |
| 4,489,959 | 12/1984 | Satterwhite | 285/18 |
| 4,707,041 | 11/1987 | Kovit et al. | 439/131 |
| 4,884,633 | 12/1989 | Legac et al. | 166/75.1 |

*Primary Examiner*—Michael Powell Buiz
*Attorney, Agent, or Firm*—David A. Rose

[57] ABSTRACT

A control system for controlling hydrocarbon flow from a well includes a hydrocarbon module and a separate control module. The hydrocarbon module includes one or more flow passages communicating with the flow of hydrocarbons from the well. Valves are disposed in the flow passages for opening and closing the passages to flow. Each valve includes a valve member having an open and a closed position. A biasing member is provided for biasing each valve member to the closed position. The control module is positioned adjacent the hydrocarbon module and includes an actuator member for each of the valve members. The valve member and actuator member are end to end such that the actuator member may be actuated to move the valve member to the open position. The valve members and actuator members engage along a common interface so as to allow the removal of the control module without removing the hydrocarbon module. Removal of the control module requires two movements, one to disengage the actuator members from the valve members, and a second movement to disengage the control module from the hydrocarbon module.

11 Claims, 5 Drawing Sheets

MODULAR CONTROL SYSTEM

BACKGROUND OF THE INVENTION

The present invention relates to control systems for wellheads on an oil or gas well, and more particularly, to a hydrocarbon module with valves for controlling the flow from the wellhead and a separate control module with the actuators for the valves on the hydrocarbon module.

In oil and gas fields, controls, sensors and valve actuators are conventionally spread over the whole structure of, for example, a subsea production tree. A previously accepted disadvantage of such an arrangement is that if any part of this equipment should fail, the tree has to be pulled for the damage to be corrected and this involves extensive workover operations and loss of production time, with the commensurate expense.

The present invention overcomes the deficiencies of the prior art.

SUMMARY OF THE INVENTION

According to the present invention, an assembly of equipment for use in a gas or oil field comprises a hydrocarbon module containing fluid flow passages which are controlled by valves having moving valve parts, and a separate control module which contains valve actuators, and which is arranged to be brought into juxtaposition with and fixed with respect to the hydrocarbon module whereby the moving parts of the valve actuators are engageable with the moving valve parts across an interface between the modules to enable operation of the valves by the actuators.

The control module may be fixed to the hydrocarbon module, or both modules may be fixed to a common base.

The hydrocarbon module can take many forms such as a production tree, a manifold, a separator or a pumping head. The valves in the hydrocarbon module may be flow valves, chokes or connectors but without their actuators, the actuators being provided separately in the control module. Most simply the moving actuator parts are rods which, at the interface between the modules, are arranged to abut end to end with respective rods forming the moving valve parts. Preferably the valves are fail safe closed and the valve rods are pushed by extension of the actuator rods to open the respective valves.

The actuators may be hydraulically or pneumatically operated pistons, or electrical actuators. A control module designed to be operated by one mode can be changed to one operated by different mode, e.g. an electric module could be replaced by an hydraulic module, without any modification to the hydrocarbon module.

In case one of the actuators should become stuck in a position in which it extends across the interface, it is desirable that the control module is coupled to the hydrocarbon module in such a way that to disengage the control module from the hydrocarbon module, the control module undergoes a first movement to disengage the actuators from the moving valve parts to allow the valves to close, while the control module and hydrocarbon module are still engaged, and a second movement to disengage the control module from the hydrocarbon module. This ensures that the control module can be safely removed after the valves have closed, even if the actuators are stuck.

In addition to containing the valve actuators, the control module may incorporate valve actuation monitoring equipment and data gathering systems. In this case the control module may be connected via a hub to a part of the hydrocarbon module which has connections downhole or by umbilical to other stations.

The advantages which stem from the invention are numerous. The central activation of all the valves in a tree structure or other hydrocarbon module by actuators in the separate control module, obviously avoids the need to locate such actuators in the tree so that if, for example, an actuator should stick, it is only necessary to release and retrieve the control module, without plugging the well and pulling the tree. A central location of controls, transmitters and actuators in the control module eliminates the need for pipe work in the tree or other hydrocarbon module and eliminates the need for many hydraulic couplings and electrical connectors.

BRIEF DESCRIPTION OF THE DRAWINGS

An example of a subsea wellhead constructed in accordance with the present invention is illustrated in the accompanying drawings, in which.

DESCRIPTION OF THE PREFERRED EMBODIMENTS

Figure 1:
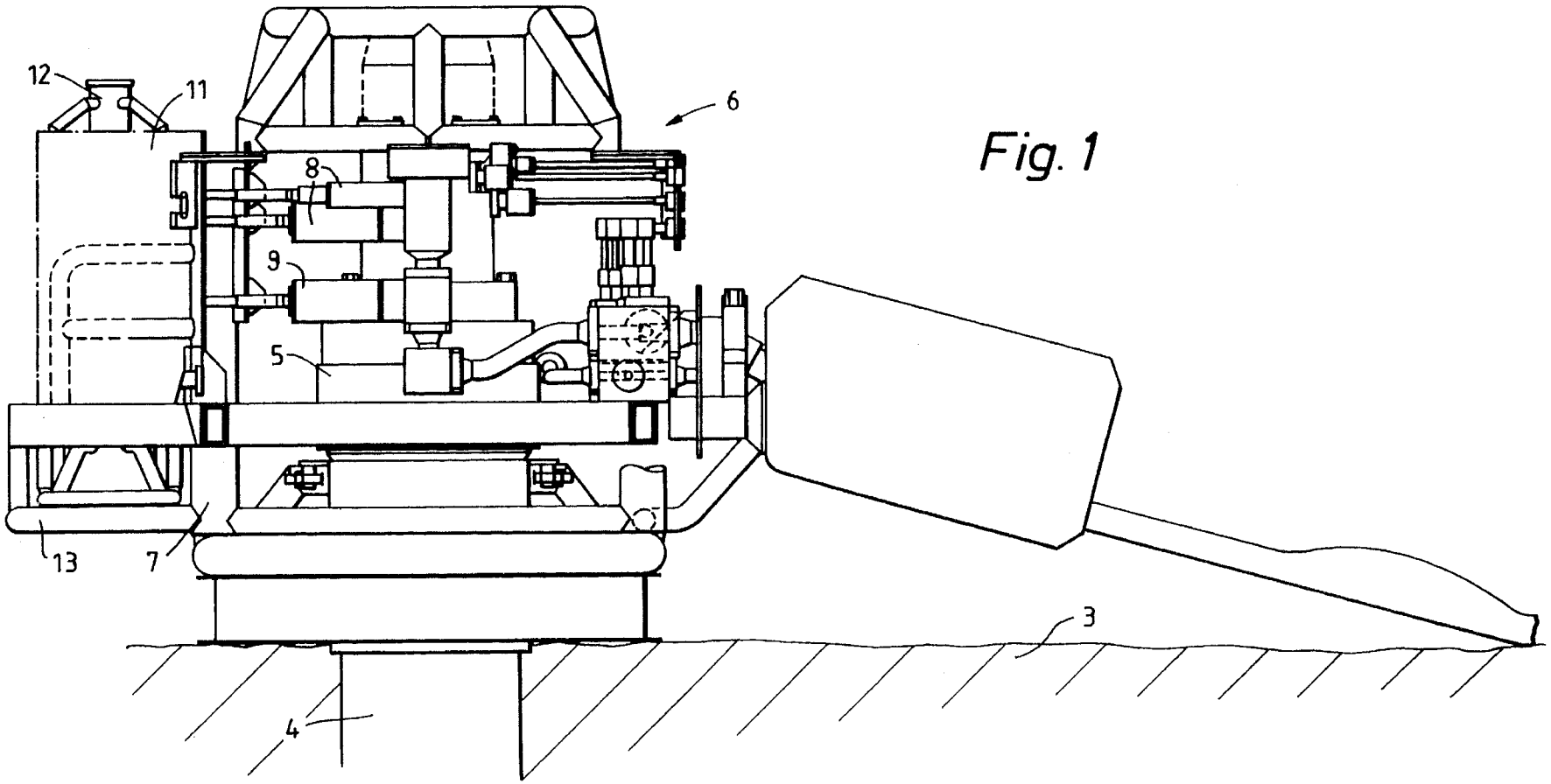
FIG. 1 is a side view of an example of a wellhead utilizing the present invention.

As illustrated in FIG. 1, the subsea wellhead 1 at the mud line 3 comprises the usual wellhead housing 4 containing concentric casings and a tree 6 within a framework 7. The tree 6 is coupled to the top of the wellhead housing 4 by a connector 5. The tree 6 may be of the kind known as a "spool tree", in which the production tubing hanger has a lateral port in alignment with a flow port in the tree, the arrangement being such that after the completion strings have been pulled, through a blowout preventer, full bore access is provided to the well through the spool tree 6 without the need to remove the spool tree 6.

In the context of the present invention, the spool tree 6 provides a hydrocarbon module through which the flow of fluids into and out of the well is controlled.

Figure 2:
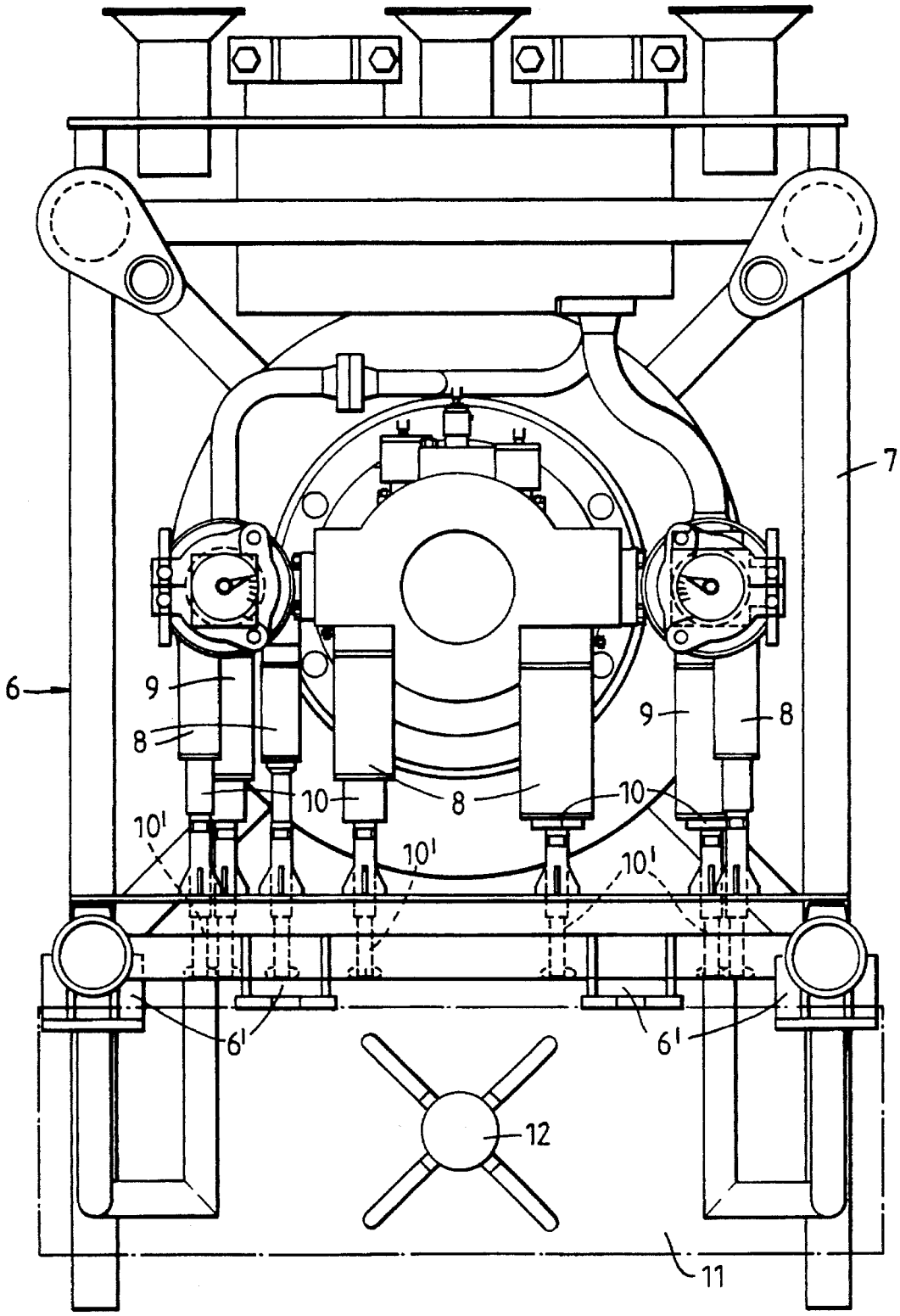
FIG. 2 is a plan view of the wellhead shown in FIG. 1.

In FIG. 2 the spool tree 6 forming the hydrocarbon module is shown to contain several parallel valves 8, which may include an annular cross over valve, an annular master valve, a production master valve, a service wing valve, and a production wing valve and chokes 9. These are all provided with mutually parallel operating rods 10 which are shown in FIG. 2 provided with extension rods 10' all terminating along a plane adjacent to the edge of the framework 7. Each of the valves 8 is operated against spring action by depression of the respective operating rod 10.

As shown in FIG. 1, a control actuation module 11 is coupled to one side of the tree 6. As shown in FIG. 3, the control actuation module 11 is provided with four T-pieces 11', which, in plan, have a T-shape cross section. As shown in FIG. 2, these are arranged to slide vertically into V-boxes 6' on the side of the tree 6 which are provided with correspondingly shaped slots. In use, the control actuation module 11 is lowered on a suspension connection 12 and brought, with an aid of a remote operated vehicle, into proximity with the spool tree 6. The control actuation module 11 is guided by the framework 7 until the T-pieces 11' slot into the V-boxes 6'. The control actuation module 11 is further lowered onto a base 13 of the tree 6 so that it is clamped into position on the side of the tree 6. The control actuation module 11 also interfaces with valve actuation monitoring equipment and data gathering systems via a hub 14 shown in FIG. 3 or a connector which is provided with electrical and hydraulic quick connect mechanisms.

Figure 3B:
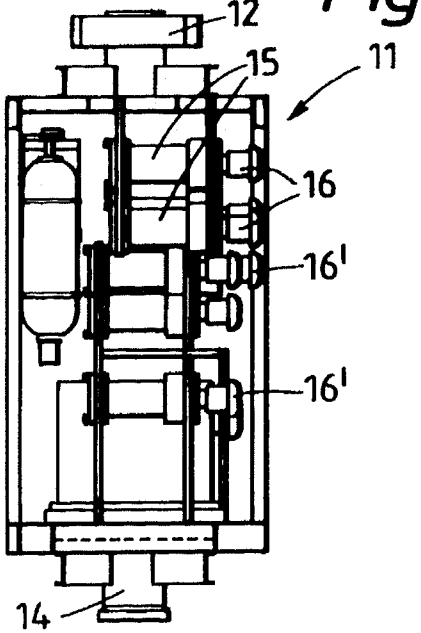
FIGS. 3A, B and C show a side elevation, an end elevation and a plan view, respectively, of an example of a control module for use with the wellhead of FIG. 1.
Figure 3A:
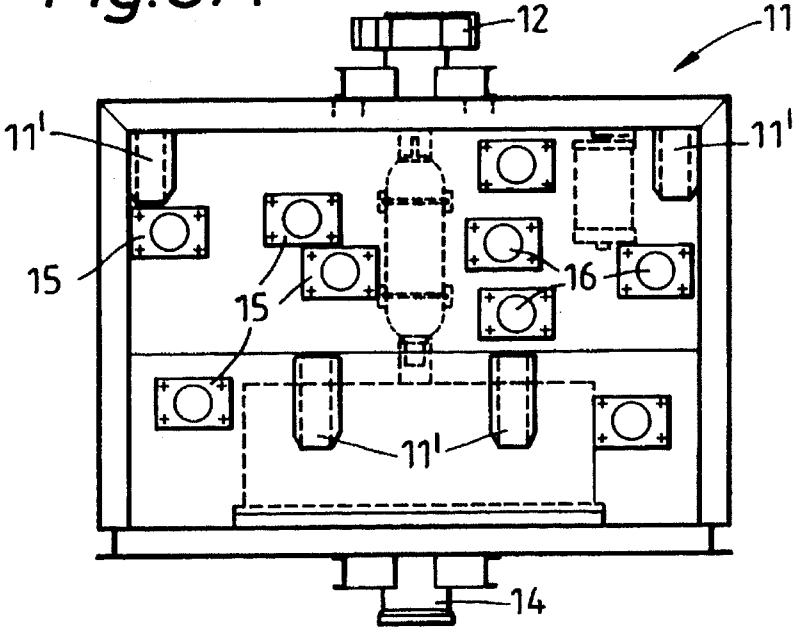
Figure 3C:
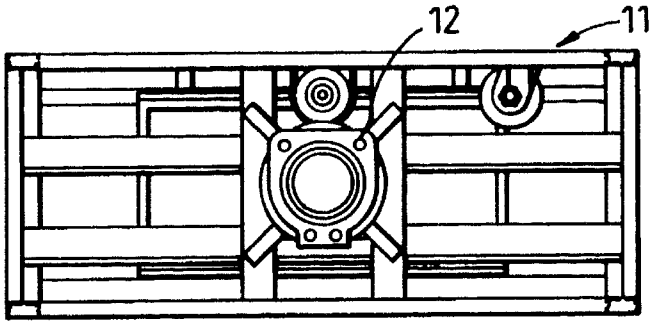

As shown particularly in FIGS. 3A and 3B, the control actuation module 11 incorporates actuators 15, each having a projecting actuating rod 16 ending in a mushroom head 16'. Each rod, when the modules are interconnected, is aligned end to end with a respective one of the valve actuating rods 10. The actuators may be electrical actuators provided with an electric motor and gear drive, similar to that shown in U.S. Pat. No. 4,920,811, or hydraulic actuators provided with a double acting cylinder arrangement. Any one of the valves 8 can then be opened by operation of the respective actuator 15 in the control module 11, causing the respective rod 16 to be extended and hence the respective rod 10 to be retracted.

Figure 4:
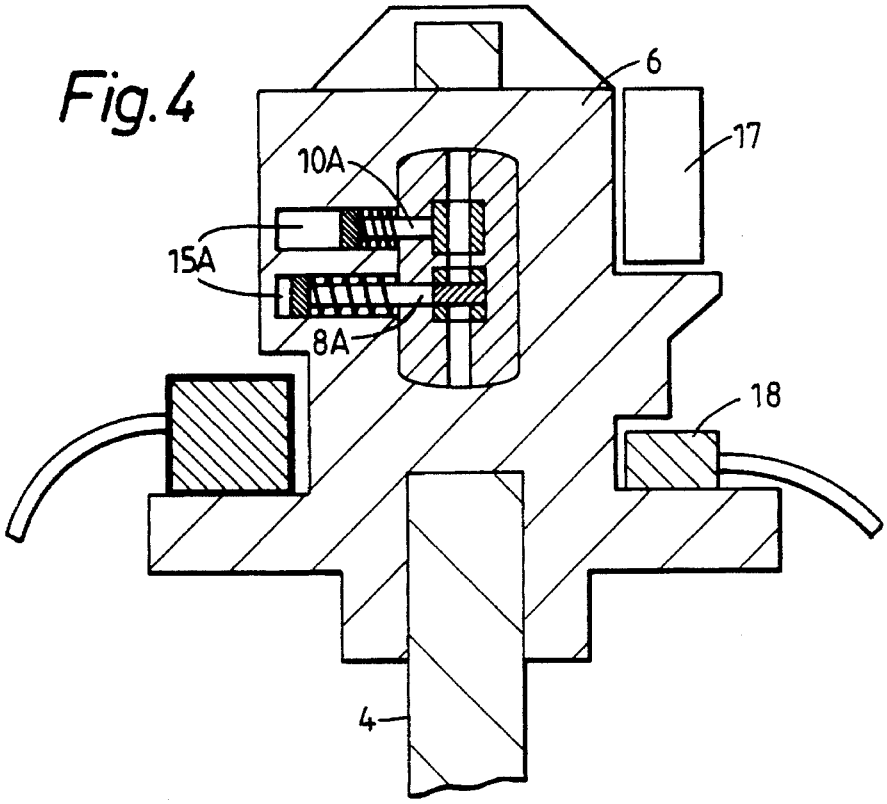
FIG. 4 is a diagrammatic sectional view of a prior art conventional wellhead of FIG. 1.
Figure 5:
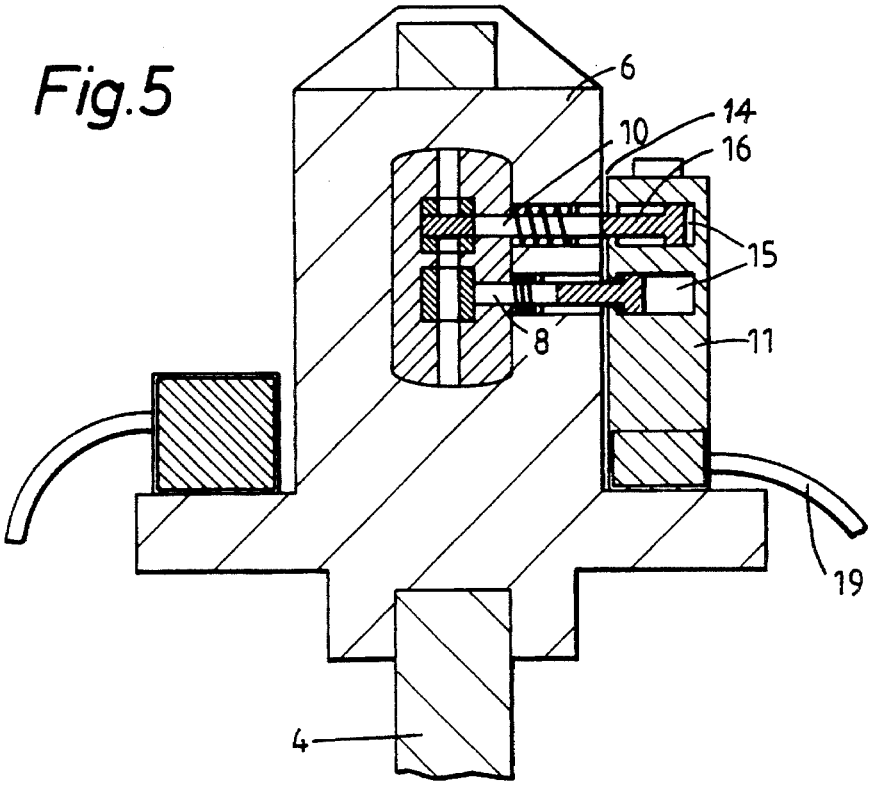
FIG. 5 is a diagrammatic sectional view of a wellhead constructed in accordance with the present invention.

The principle of the invention is best illustrated by a comparison of the conventional arrangement as shown in FIG. 4 with the inventive arrangement shown in FIG. 5. In FIG. 4 the actuators 15A are provided within the tree 26. A separate control module 17 which has numerous hydraulic and electrical lines is provided for the control of the valves in tree 26. A separate umbilical connection 18 is provided for the source of energy such as hydraulic and/or electrical power. By contrast, in FIG. 5, the actuators 15 and associated controls are provided in the separate control module 11 with the actuating rods 16 engaging with the respective valve operating rods 10 across the common interface 14 between the control module 11 and hydrocarbon module 6. An umbilical connection 19 for the source of hydraulic and/or electrical power is provided directly to the control module 11.

The valve actuators 15 can operate vertically instead of horizontally and the control module 11 can be landed in a different attitude relative to the hydrocarbon module 6, subject to an appropriate interface between the valve moving parts, such as the rods 10, and the actuator moving parts, such as the rods 15.

Figure 6:
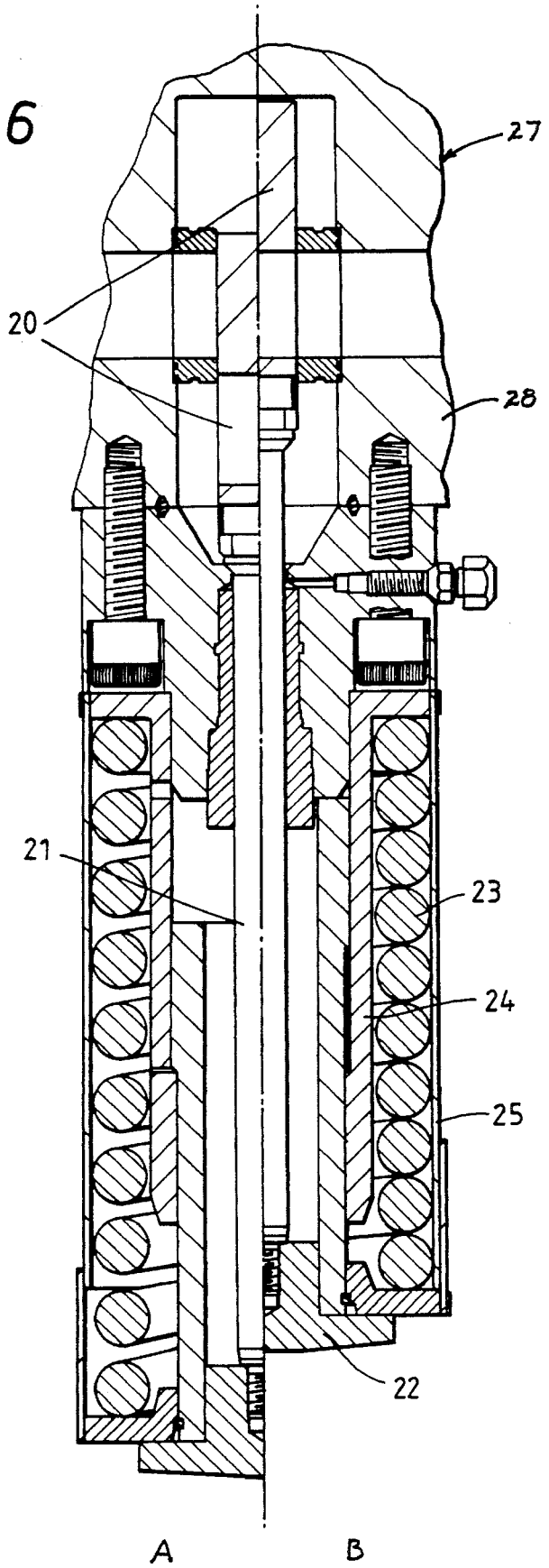
FIGS. 6A and B is a sectional view of a valve for use with the wellhead of FIG. 1 with FIG. 6A showing the valve in the closed configuration and FIG. 6B showing the valve in the open configuration.

A valve 27 suitable for use in the hydrocarbon module 6 is shown in FIG. 6. The closure element is provided by a gate 20 which is shown in an open position in FIG. 6B and in a closed position in FIG. 6A. The gate 20 is connected to a stem 21 which extends out through the opposite end of the housing 28 of valve 27 to the gate 20 where it terminates in a mushroom head 22 which, in use, is engaged by an actuating rod 16. The stem 21 can be provided with any extension rod, for example as shown in FIG. 2 so that it extends to the edge of the tree 6. A spring 23 is provided in a spring cartridge 24 and is arranged to bias the valve 27 into a closed position as shown in FIG. 6A. The spring 23 is surrounded by a sleeve 25 which is telescopic so that it does not project beyond the mushroom head 22 when the valve 27 is open. Thus, when the actuating rod 16 is retracted, the spring 23 provides a fail safe closed operation.

In the event of malfunction, the least reliable parts are in the control module 11, and module 11 can be readily disconnected and raised to the surface for repair without disturbing the tree 6, or having to break any hydrocarbon connection on the wellhead.

If an actuating rod 16 should become stuck in a position in which it extends across the interface 14 between the hydrocarbon module 6 and control module 11, the control module 11 has to be moved first vertically so that the stuck actuator rod 16 is no longer in alignment with the respective operating rod 10, while the module 11 still remains fixed against horizontal movement away from the tree 6 by virtue of the engagement between T-pieces 11' and V-boxes 6'. This vertical movement releases the actuating rod 10 and allows the spring 23 to force the valve into a closed position. The actuating rod 16 is now isolated from the tree 6, and the control module 11 can be removed safely by further vertical movement to bring the T-pieces 11' out of the V-boxes 6'.

While a preferred embodiment of the invention has been shown and described, modifications thereof can be made by one skilled in the art without departing from the spirit of the invention.

We claim:

1. An assembly of equipment for use in a gas or oil field comprising:

a hydrocarbon module containing fluid flow passages which are controlled by moving valve parts; and a separate control module which contains valve actuators, and which is arranged to be brought into juxtaposition with and fixed with respect to the hydrocarbon module whereby moving parts of the valve actuators arc engageable with the moving valve parts across an interface between the modules to enable operation of the valves by the actuators.

2. An assembly according to claim 1, wherein the control module is fixed to the hydrocarbon module.

3. An assembly according to claim 1, wherein the control module and hydrocarbon module are fixed to a common base.

4. An assembly according to claim 1, wherein the moving actuator parts are rods which, at the interface between the modules, are arranged to abut end to end with respective rods forming the moving valve parts.

5. An assembly according to claim 1, wherein the valves are fail safe closed and the valve rods are pushed by extension of the actuator rods to open the respective valves.

6. An assembly according to claim 1, wherein the control module incorporates valve actuation monitoring equipment and data gathering systems.

7. An assembly according to claim 6, wherein the control module is connected via a hub to a part of the hydrocarbon module.

8. An assembly according to claim 1, wherein the control module is coupled to the hydrocarbon module in such a way that to disengage the control module from the hydrocarbon module, the control module undergoes a first movement to disengage the actuators from the moving valve parts to allow the valves to close, while the control module and hydrocarbon module are still engaged, and a second movement to disengage the control module from the hydrocarbon module.

9. A control system for controlling hydrocarbon flow from a wellhead, comprising:

a valve module having at least one flow passage connected to the wellhead for the flow of hydrocarbons;

a valve disposed in the flow passage for opening and closing the flow passage to hydrocarbon flow, said valve having a valve member with an open position permitting hydrocarbon flow and a closed position preventing hydrocarbon flow;

an actuator module juxtaposed to said valve module and having an actuator member engaging but not connected to said valve member;

said actuator module adapted for connection to a source of energy for moving said actuator member into engagement with said valve member to move said valve member to said open position and for disengaging said actuator member from said valve member for closing said valve.

10. The control system of claim 9 wherein said valve module further includes a closing member for moving said valve member to said closed position upon the disengagement of said actuator member.

11. A control system for controlling hydrocarbon flow from a wellhead, comprising:

a frame mounted on the wellhead;

a production tree positioned on said frame for connection to the wellhead and having a plurality of flow passages therethrough;

a plurality of valves disposed on said production tree for controlling flow through said flow passages, each of said valves having a valve member with a retracted position in said valve for opening a flow passage and an extended position from said valve for closing a flow passage;

each of said valve members having one end extending to a common plane in said extended position;

a control module positioned on said frame adjacent said production tree and having an actuator member for each valve member; said actuator members having one end extending into said common plane for engaging said ends on said valve members; said control module adapted for connection to a source of energy for actuating said actuator members whereby upon individual actuation, one of said actuation members engages one of said valve members and moves said valve member to said retracted position; and said control module being removable from said frame after disconnection from said production tree.

* * * * *